US010011406B2

(12) United States Patent
Daley et al.

(10) Patent No.: US 10,011,406 B2
(45) Date of Patent: Jul. 3, 2018

(54) CHILD-RESISTANT SENIOR-FRIENDLY MEDICATION BOTTLE

(71) Applicant: CVS Pharmacy, Inc., Woonsocket, RI (US)

(72) Inventors: Bennett P. Daley, Waltham, MA (US); Ryan Neil Peter Hall, Clinton, MA (US); Michael David Miller, Tewksbury, MA (US); Daniel Nelsen, Central Falls, RI (US); Peter Rezac, Sterling, MA (US); Timothy Andrew Vanderpoel, Hudson, MA (US)

(73) Assignee: CVS Pharmacy, Inc., Woonsocket, RI (US)

( * ) Notice: Subject to any disclaimer, the term of this patent is extended or adjusted under 35 U.S.C. 154(b) by 0 days.

(21) Appl. No.: 15/344,999

(22) Filed: Nov. 7, 2016

(65) Prior Publication Data

US 2018/0127174 A1 May 10, 2018

(51) Int. Cl.

| | |
|---|---|
| ***B65D 50/06*** | (2006.01) |
| ***A61J 1/03*** | (2006.01) |
| ***A61J 1/14*** | (2006.01) |
| ***B65D 1/02*** | (2006.01) |
| ***B65D 50/04*** | (2006.01) |
| ***B65D 41/04*** | (2006.01) |

(52) U.S. Cl.

CPC ..... *B65D 50/063* (2013.01); *A61J 1/03* (2013.01); *A61J 1/1418* (2015.05); *B65D 1/0246* (2013.01); *B65D 41/0407* (2013.01); *B65D 50/046* (2013.01)

(58) Field of Classification Search

CPC .. B65D 50/063; B65D 50/064; B65D 50/045; B65D 50/046; B65D 50/04; B65D 1/0246; B65D 1/023; B65D 1/0223; B65D 41/0407; B65D 41/04; A61J 1/03; A61J 1/1418; A61J 1/1412

USPC ... 215/44, 43, 217, 201, 222, 332, 329, 316, 215/218, 216, 209, 211, 382; 220/302, 220/301, 296, 293, 288; D9/560, 559, D9/563, 443, 435; 206/459.5

See application file for complete search history.

(56) References Cited

U.S. PATENT DOCUMENTS

| | | | |
|---|---|---|---|
| 2,776,066 | A | 1/1957 | Thornton |
| 3,252,492 | A | 5/1966 | Marchant |

(Continued)

OTHER PUBLICATIONS

Grumpy Foot, Square Bottle by Ex-Apple Engineers, 2017 earliest online date, retrieved from https://www.grumpfoot.com/square-bottle-by-former-apple-engineers/, Sep. 7, 2017, 3 pgs.

(Continued)

*Primary Examiner* — Robert J Hicks

(74) *Attorney, Agent, or Firm* — Patent Law Works LLP

(57) ABSTRACT

A bottle that includes a body, a neck, stops on the neck defining a lug retention area. The body defines a storage chamber therein. The neck extends away from the body and defines an opening to the chamber of the body. The neck includes threads extending around an outside surface of the neck. The stops extend from a bottom of a first thread toward the body, the stops defining the lug retention area. The closure is secured over the opening and around the neck. The closure includes a lug configured to interface with the thread and engage with the lug retention area to retain the closure in place over the opening.

15 Claims, 18 Drawing Sheets

(56) References Cited

U.S. PATENT DOCUMENTS 3,405,831 A * 10/1968 Hudson ..... B65D 41/0471 215/330
3,794,200 A * 2/1974 Marks ..... B65D 41/0471 215/201
3,993,209 A * 11/1976 Julian ..... B65D 50/046 215/216
4,098,419 A * 7/1978 Virog, Jr. ..... B65D 41/3409 215/252
4,387,817 A 6/1983 Wiles et al.
4,877,144 A * 10/1989 Thanisch ..... B29C 45/2622 215/330
5,184,741 A * 2/1993 Chevassus ..... B65D 41/0471 215/217
D360,134 S 7/1995 Snyder
5,662,233 A * 9/1997 Reid ..... B65D 41/0471 215/217
5,803,287 A * 9/1998 Kusz ..... B65D 41/0471 215/330
6,123,212 A * 9/2000 Russell ..... B65D 41/0471 215/307
D442,868 S 5/2001 Gavin
D456,272 S 4/2002 Sadeghi et al.
D481,640 S 11/2003 Biesecker
6,802,418 B2 10/2004 Atkinson et al.
D498,143 S 11/2004 Rashid
D531,913 S 11/2006 Heisner et al.
D539,651 S 4/2007 Snyder
D540,669 S 4/2007 George et al.
D576,876 S 9/2008 Mount
D587,586 S 3/2009 Patzak
D619,473 S 7/2010 Biesecker et al.
D620,369 S 7/2010 Servaire et al.
D622,591 S 8/2010 Biesecker et al.
D630,518 S 1/2011 Biesecker et al.
D639,669 S 6/2011 Adler et al.
D654,799 S 2/2012 Liu
D678,074 S 3/2013 De France
D691,054 S 10/2013 Olsson et al.
8,616,407 B2 12/2013 Sawicki
D698,250 S 1/2014 Wade et al.
D698,251 S 1/2014 Wade et al.
D733,787 S 7/2015 Baker et al.
D733,788 S 7/2015 Baker et al.
D736,635 S 8/2015 Sadler et al.
D739,759 S 9/2015 Warner et al.
D742,242 S 11/2015 McDaniel et al.
D754,240 S 4/2016 Samuels et al.
D756,234 S 5/2016 Orset
D765,508 S 9/2016 Wu
D772,659 S 11/2016 Middleton et al.
D776,544 S 1/2017 Staab
D786,086 S 5/2017 Miller et al.
D786,674 S 5/2017 Miller et al.
D786,683 S 5/2017 Miller et al.
D792,233 S 7/2017 Miller et al.
2004/0173562 A1 9/2004 Wolfe
2006/0255041 A1 11/2006 Parks et al.
2007/0034595 A1 2/2007 Foster et al.
2009/0152229 A1* 6/2009 Falzoni ..... B65D 41/3409 215/40
2009/0223985 A1* 9/2009 Carmody ..... B65D 41/0471 220/780
2009/0266736 A1 10/2009 Sprishen et al.
2011/0049085 A1* 3/2011 Lembke ..... B65D 1/0276 215/382
2011/0094990 A1 4/2011 Sprishen et al.
2012/0152882 A1 6/2012 Tune
2015/0329232 A1* 11/2015 Brozell ..... C03B 9/325 215/44
2017/0057711 A1 3/2017 Miller et al.

OTHER PUBLICATIONS

Lulusoso, Perfume Bottle Cap, May 29, 2012, earliest online date, retrieved from http://sell.lulusoso.com/selling-leads/1961487/Perfume-Bottle-Cap-Square-shape-Plastic-material.html, Sep. 7, 2017, 7 pgs.
International Search Report and Written Opinion for PCT/US2017/059602, dated Feb. 1, 2018, 15 pgs.

* cited by examiner

CHILD-RESISTANT SENIOR-FRIENDLY MEDICATION BOTTLE

BACKGROUND

1. Field of the Invention

The present invention is directed to a pharmacy container system that improves the ease of use of a child-resistant senior-friendly (CRSF) and non-child-resistant (non-CR) closure for the pharmacy container

2. Description of the Background Art

Virtually everyone consumes prescription pharmaceuticals at one time or another. A history of incidents involving children opening and ingesting the contents of prescription medication bottles has led to regulation requiring child-resistant (CR) packaging. However, CR medication bottles can present a problem for some aged individuals or people with disabilities. Consequently, further regulation requires that CR designs be tested to verify that most adults can open the package. The resulting medication bottles have child-resistant senior-friendly (CRSF) closures that typically require two distinct motions to open the bottle. In view of at least the above issues, CRSF prescription medication containers that make a prescription medication bottle easier to use are desirable.

SUMMARY

A pharmacy container comprising a bottle and a closure is disclosed herein. The bottle includes a body, a neck, stops on the neck defining a lug retention area. The body defines a storage chamber therein. The neck extends away from the body and defines an opening to the chamber of the body. The neck includes threads extending around an outside surface of the neck. The stops extend from a bottom of a first thread toward the body, the stops defining the lug retention area. The closure is secured over the opening and around the neck. The closure includes a lug configured to interface with the thread and engage with the lug retention area to retain the closure in place over the opening. Other labels, bottles, associated combinations, and associated methods are also disclosed.

BRIEF DESCRIPTION OF THE DRAWINGS

Various embodiments will be illustrated by way of example, and not by way of limitation in the figures of the accompanying drawings in which like reference numerals are used to refer to similar elements.

DETAILED DESCRIPTION

In the following detailed description, reference is made to the accompanying drawings, which form a part hereof, and in which is shown by way of illustration specific embodiments. The following detailed description, therefore, is not to be taken in a limiting sense.

Embodiments described herein are directed to a pharmacy container system that improves the ease of use of a child-resistant senior-friendly (CRSF) and non-child-resistant (non-CR) closure for the pharmacy container. In one embodiment, a pharmacy system comprises a plurality of bottles and closures. The plurality of bottles are sized and shaped to hold a different volume of medication, such as pills, syrup, or other forms of medication. In one embodiment, the plurality of bottles are provided in a number of sizes. However, a neck of each of the different sized bottles is sized substantially identical such that all sizes of bottles are configured to receive the same closures. In one embodiment, other common structure of the different sized bottles provide for additional functions, such as label placement and alignment.

Forming the bottles with similar necks and associated components to receive the same closures decreases the number of items needed in a pharmacy inventory, which is desirable as it increases the ease of stocking the pharmacy and the space needed to store the various pharmacy system components. For example, in one embodiment, the number of inventoried items in a system of three sizes of bottles with CRSF and non-CR closures can be reduced from nine (e.g., three bottles sizes, three differently sized CRSF closures, and three differently sized non-CR closures) to five (e.g., three bottle sizes, one size CRSF closure, and one size non-CR closure).

Figure 1:
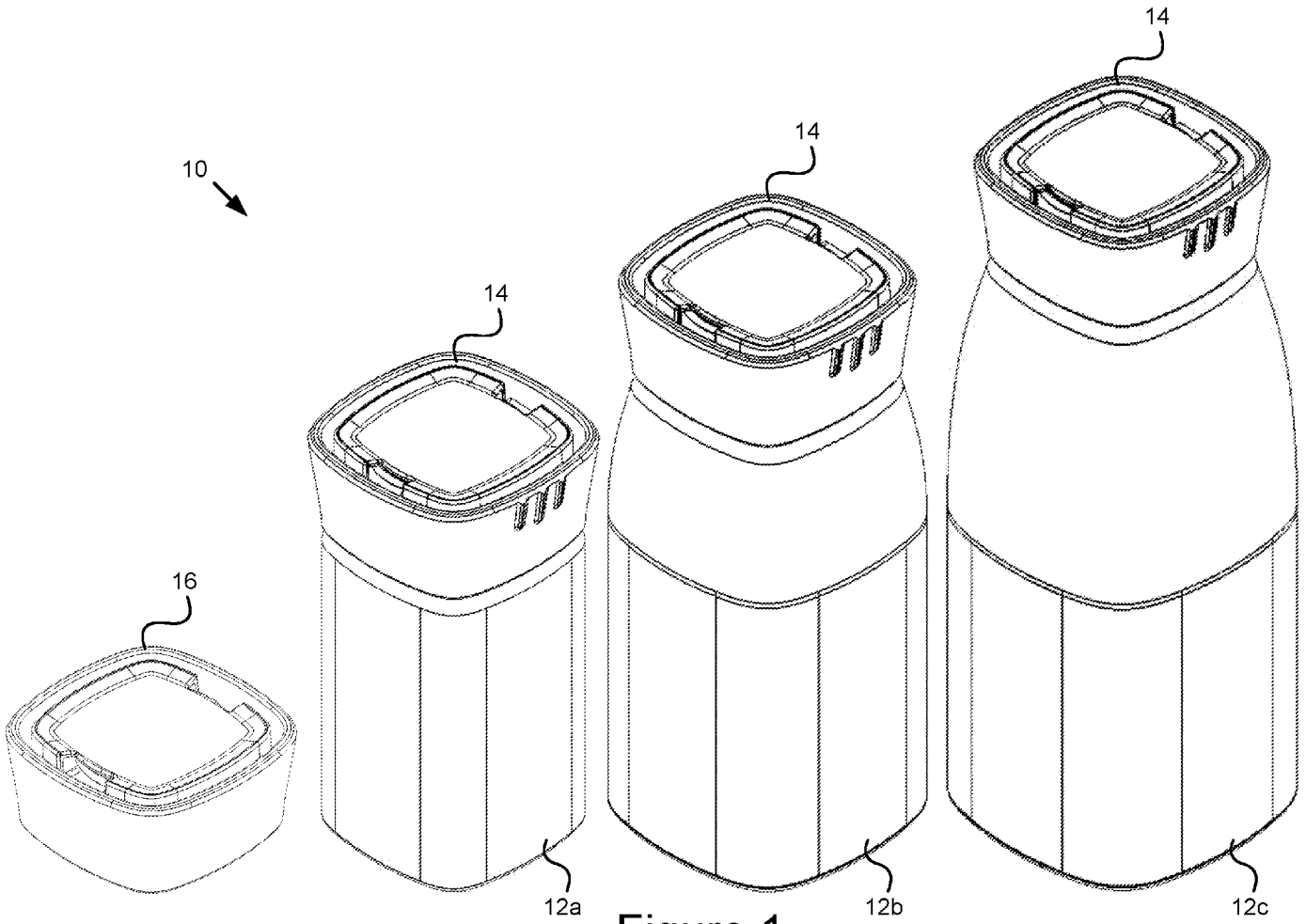
FIG. 1 is a front, top, perspective view illustration a pharmacy system including a plurality of bottles and a plurality of closures, according to one embodiment.
Figure 2:
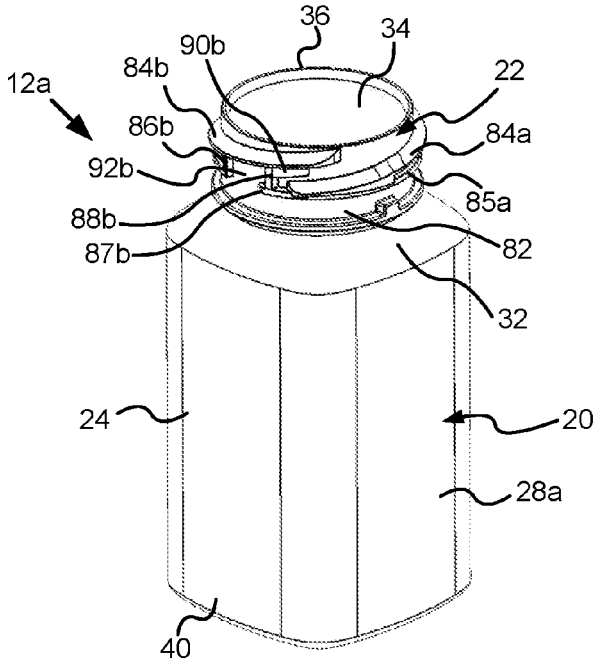
FIG. 2 is a front, top, and perspective view illustration of a first bottle of the plurality of bottles in FIG. 1, according to one embodiment.

Referring to the figures, FIG. 1 illustrates a pharmacy container system 10 including a plurality of bottles 12 (including bottles 12*a*, 12*b*, and 12*c*, each being a different size), a CRSF closure 14, and a non-CR closure 16. Both CRSF closure 14 and non-CR closure 16 are configured to securely fit with and be coupled to each of the plurality of bottles 12, regardless of the specific bottle size. In one example, a bottle 12 and CRSF closure 14 or non-CR closure 16 assembly is considered a pharmacy container. In one embodiment, bottle 12*a* is a 17 dram bottle. In one embodiment, bottle 12*b* is a 40 dram bottle. In one embodiment, bottle 12*c* is a 60 dram bottle.

FIGS. 2-14 illustrate various views of bottle 12*a*, which is the one of the plurality of bottles 12 that is smallest in size, according to one embodiment. Bottle 12*a* includes a body 20 and a neck 22 extending from body 20 and defining an opening 36 opposite body 20 providing access to a storage chamber 34 of bottle 12*a* for containing a medication. As such, body 20 is one example of means for containing medication in storage chamber 34.

In one embodiment, body 20 includes a front panel 24, a rear panel 26, a right side panel 28*a*, a left side panel 28*b*, and a spine or bottom panel 30. Front panel 24 is positioned opposite rear panel 26, and one of side panels 28 extends between front panel 24 and rear panel 26 on either side of bottle 12*a* to define storage chamber 34 therebetween. Bottom panel 30 extends between front panel 24, rear panel 26, and side panels 28 to enclose an end of bottle 12*a*. In one embodiment, bottom panel 30 includes a substantially planar center portion 38 such that bottle 12*a* can be placed with bottom panel 30 on a support surface (not shown) and bottle 12*a* will be supported by and extend upwardly from bottom panel 30. In one embodiment, bottom panel 30 includes a shoulder portion 39 extending between the substantially planar center portion 38 and the front panel 24, rear panel 26, and side panels 28. In one embodiment, the substantially planar center portion 38 and the shoulder portion 39 of bottle 12*a* are configured to nest in CRSF closure 14 or non-CR closure 16 to provide for stacking of pharmacy containers.

Neck 22 extends away from a portion of bottle 12*a* opposite bottom panel 30 to form an end of bottle 12*a* opposite bottom panel 30. In one embodiment, body 20 of bottle 12*a* defines shoulders 32 extending from front panel 24, rear panel 26, and side panels 28 to neck 22 opposite bottom panel 30. Neck 22 defines opening 36 through body 20, and opening 36 provides access to storage chamber 34 permitting medication to be placed in and be removed from storage chamber 34 via opening 36. In one embodiment, neck 22 is threaded (e.g., double threaded as depicted by threads 84*a* and 84*b*), and defines opening 36 through body 20 providing access through neck 22 to storage chamber 34 such that threaded neck 22 is configured to receive either CRSF closure 14 or non-CR closure 16 to cover opening 36. As such, neck 22 with opening 36 with threads 84 is one example of means for providing access to storage chamber 34 and for selectively receiving a closure (e.g., CRSF closure 14 or non-CR closure 16). Embodiments of neck 22 are further described below.

In one embodiment, front panel 24 and rear panel 26 of body 20 each define a substantially planar surface 40 and 42, respectively, that is substantially rectangularly shaped, thereby defining a generally flat, broad surface especially suited for reading information on portions of a label (not shown) applied thereto. For example, substantially planar surfaces 40 and 42 enable display of label information in a manner in which all of the information printed on a portion of a label applied to each of substantially planar surfaces 40 and 42 can be read without turning or rotating bottle 12*a*.

In one embodiment, the relatively broad nature of substantially planar surfaces 40 of front panel 24, rear panel 26, and side panels 28 of body 20 enable a bottle 12 to be set down on its side (i.e., not on one of CRSF closure 14, non-CR closure 16, or bottom panel 30) onto a support surface without bottle 12*a* rolling along the support surface. In particular, the breadth and relative flatness of front panel 24, rear panel 26, and side panels 28 prevent rolling of bottle 12*a* when any one of front panel 24, rear panel 26, and side panels 28 are placed directly on the support surface.

Figure 3:
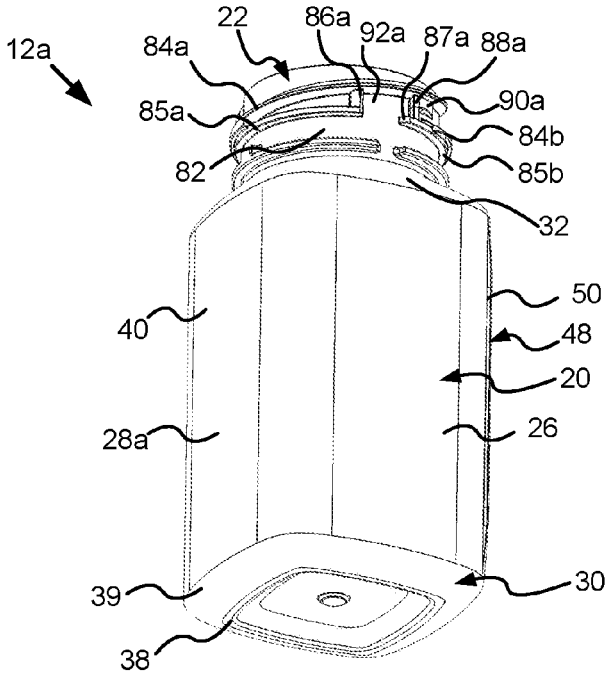
FIG. 3 is a rear, bottom, and perspective view illustration of the first bottle of FIG. 2, according to one embodiment.
Figure 4:
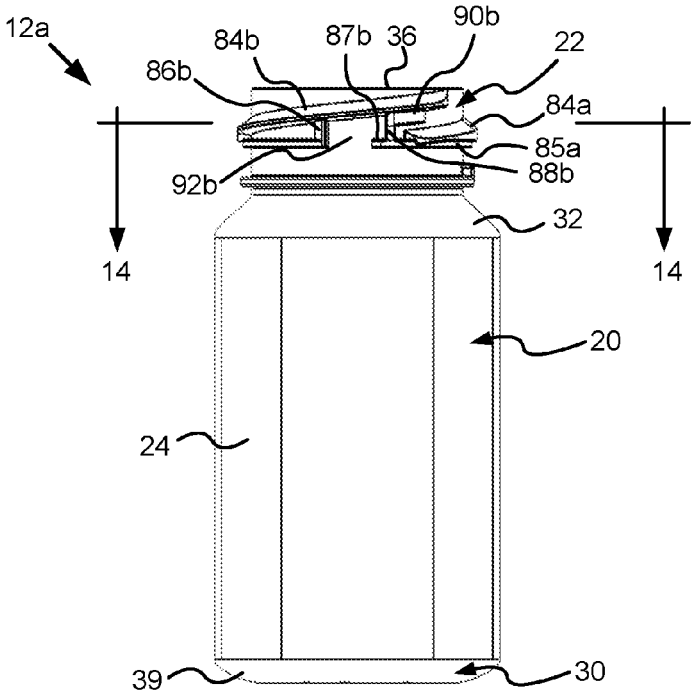
FIG. 4 is a front view illustration of the first bottle of FIG. 2, according to one embodiment.
Figure 5:
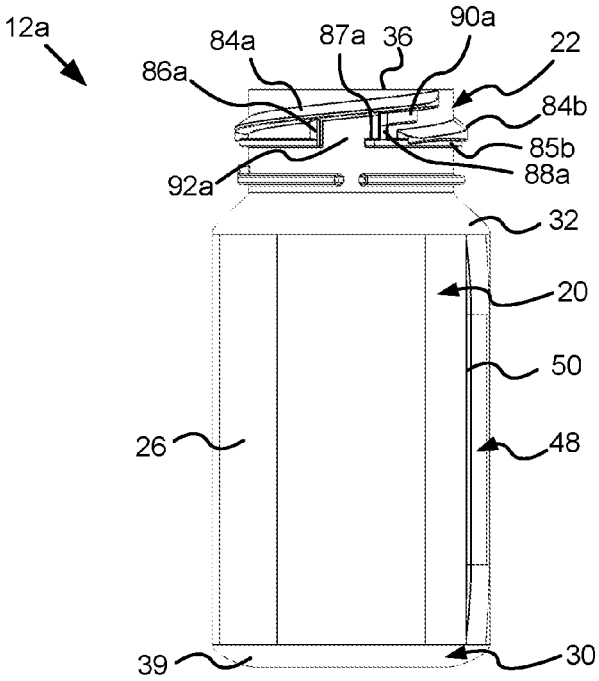
FIG. 5 is a rear view illustration of the first bottle of FIG. 2, according to one embodiment.
Figure 6:
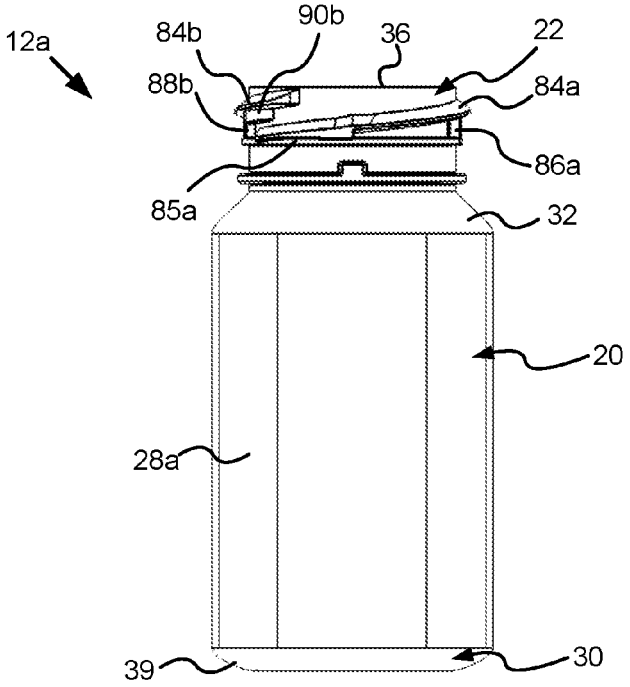
FIG. 6 is a right side view illustration of the first bottle of FIG. 2, according to one embodiment.
Figure 7:
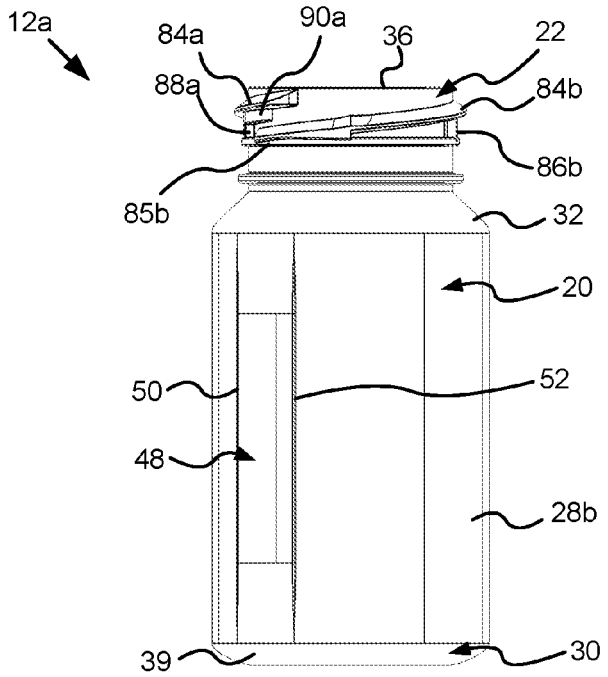
FIG. 7 is a left side view view illustration of the first bottle of FIG. 2, according to one embodiment.
Figure 8:
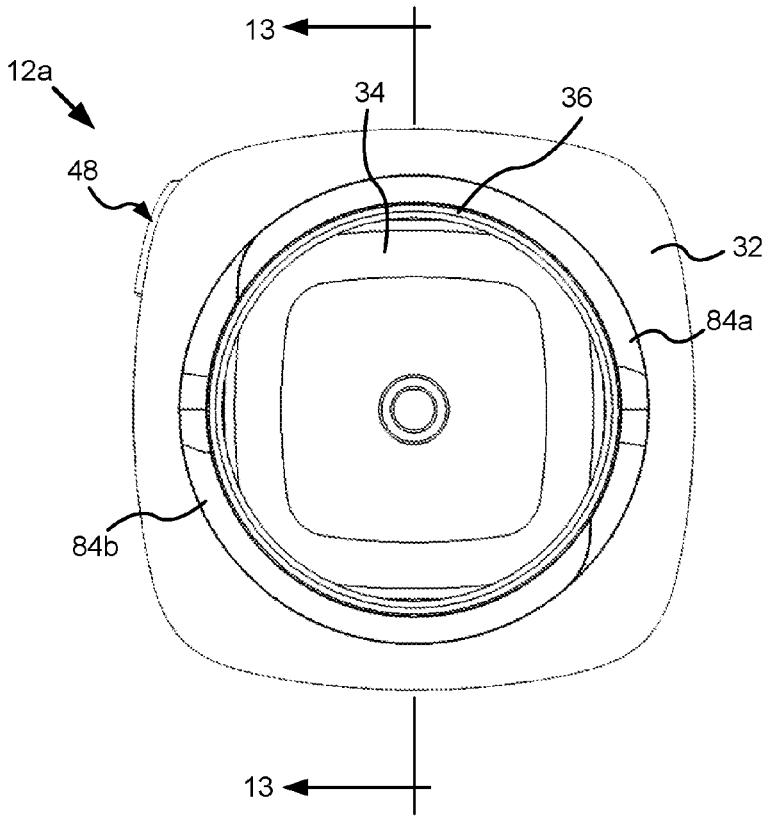
FIG. 8 is a top view illustration of the first bottle of FIG. 2, according to one embodiment.
Figure 9:
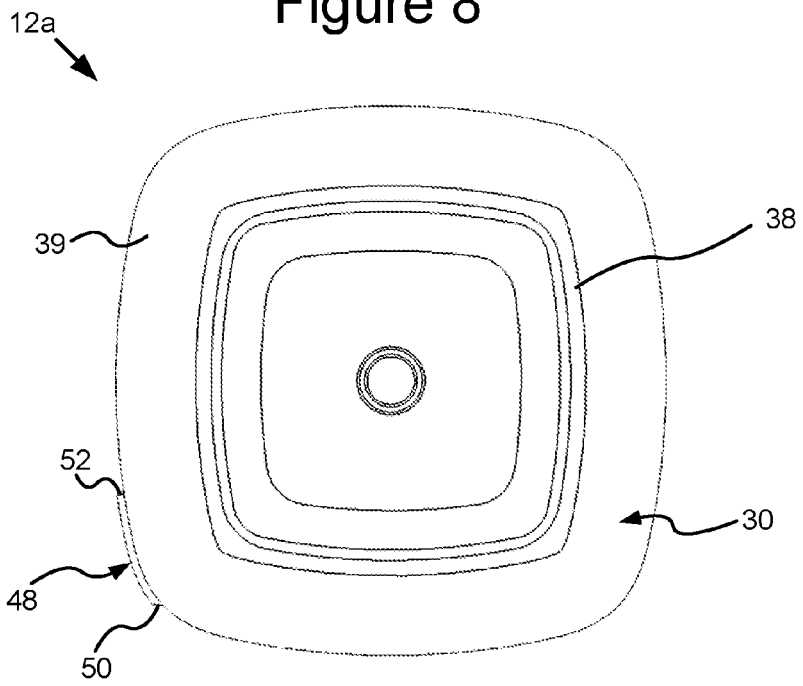
FIG. 9 is bottom view illustration of the first bottle of FIG. 2, according to one embodiment.
Figure 10:
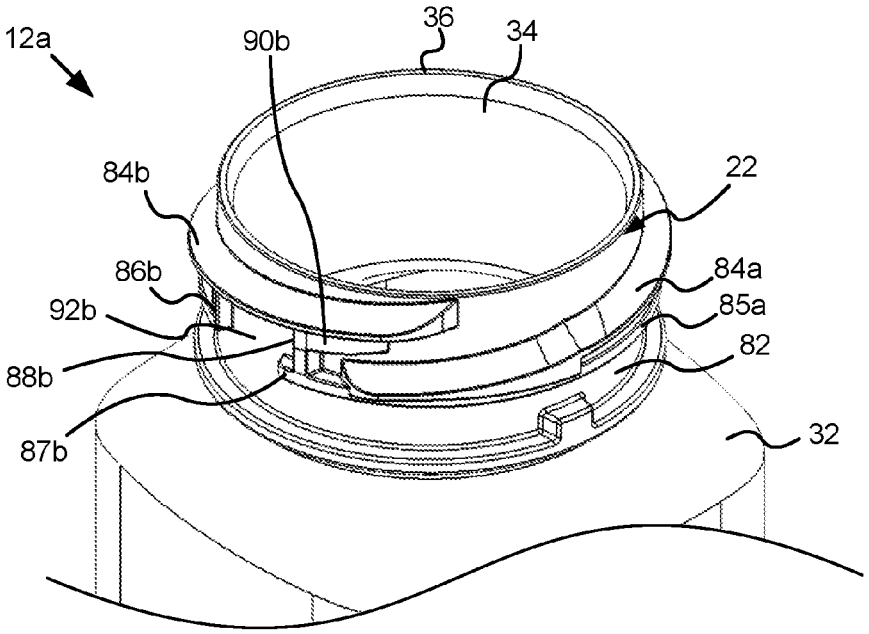
FIG. 10 is a detail view of a portion of the first bottle of FIG. 2, according to one embodiment.
Figure 11:
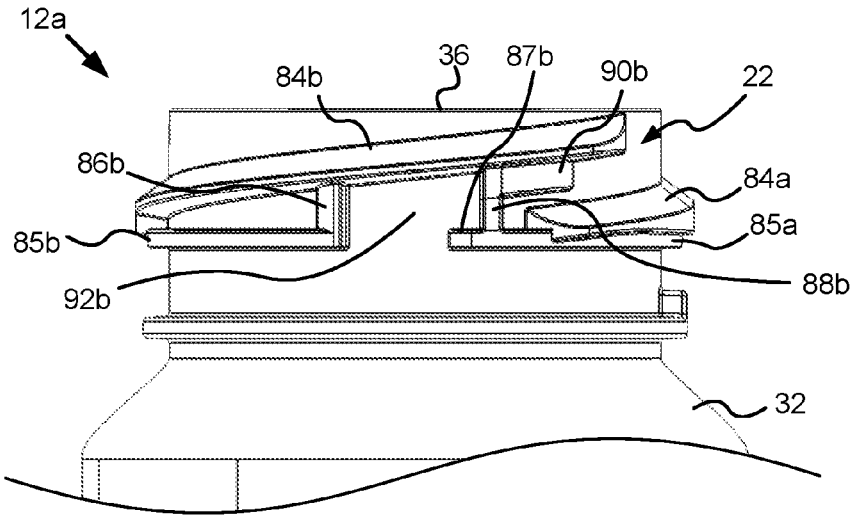
FIG. 11 is a detail view of a portion of the first bottle of FIG. 4, according to one embodiment.
Figure 12:
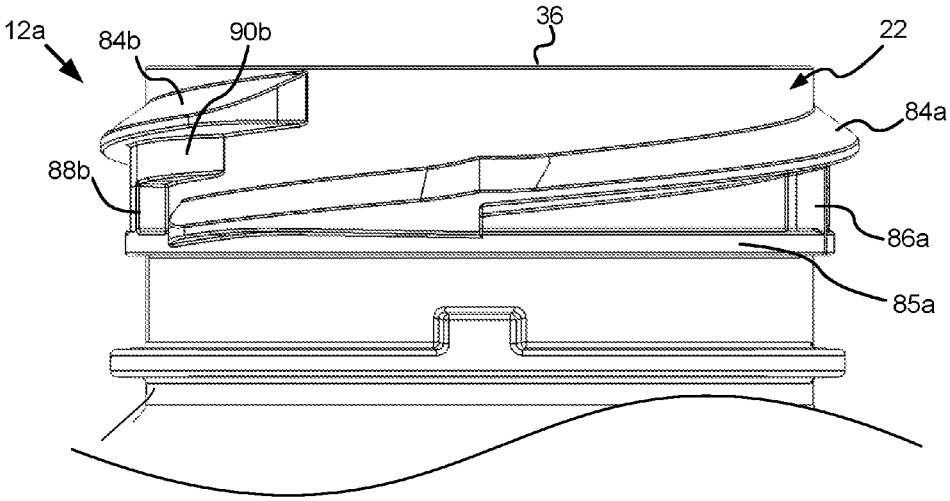
FIG. 12 is a detail view of a portion of the first bottle of FIG. 6, according to one embodiment.
Figure 13:
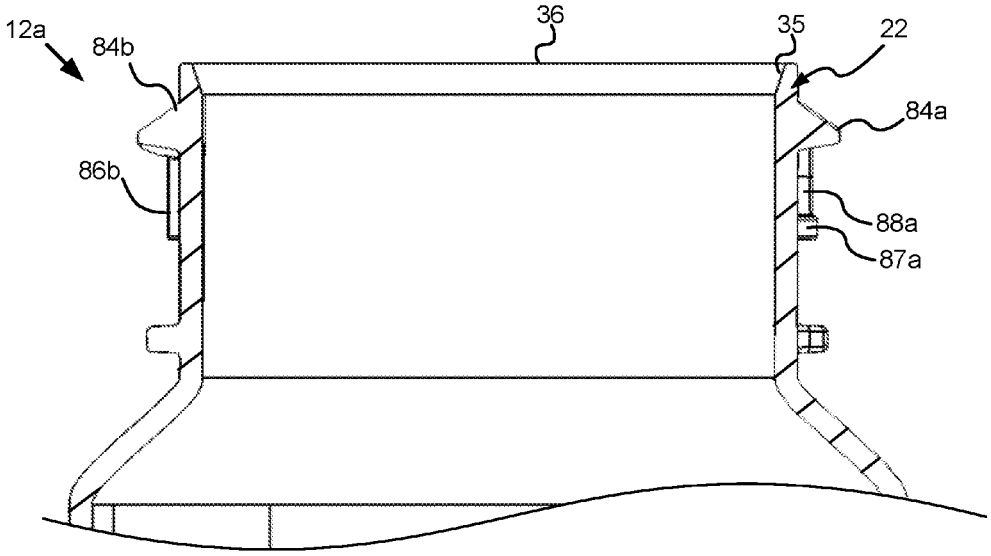
FIG. 13 a cross-sectional view illustration of the first bottle taken along line 13-13 in FIG. 8, according to one embodiment.
Figure 14:
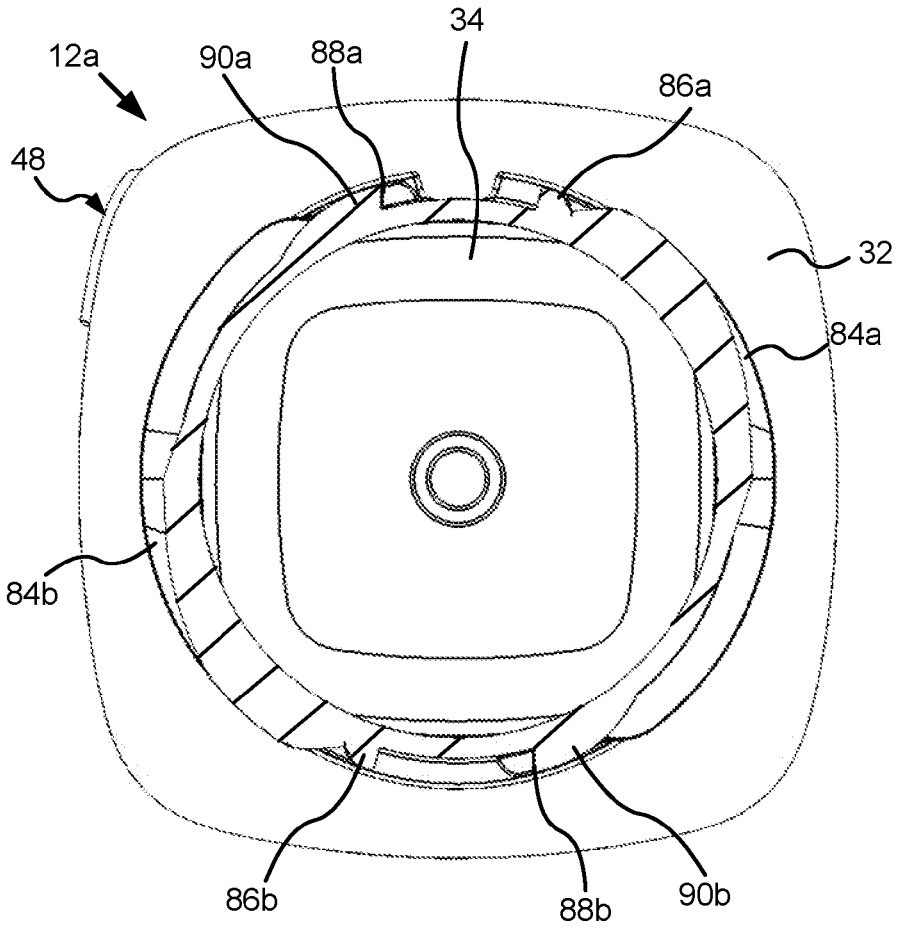
FIG. 14 a cross-sectional view illustration of the first bottle taken along line 14-14 in FIG. 4, according to one embodiment.
Figure 15:
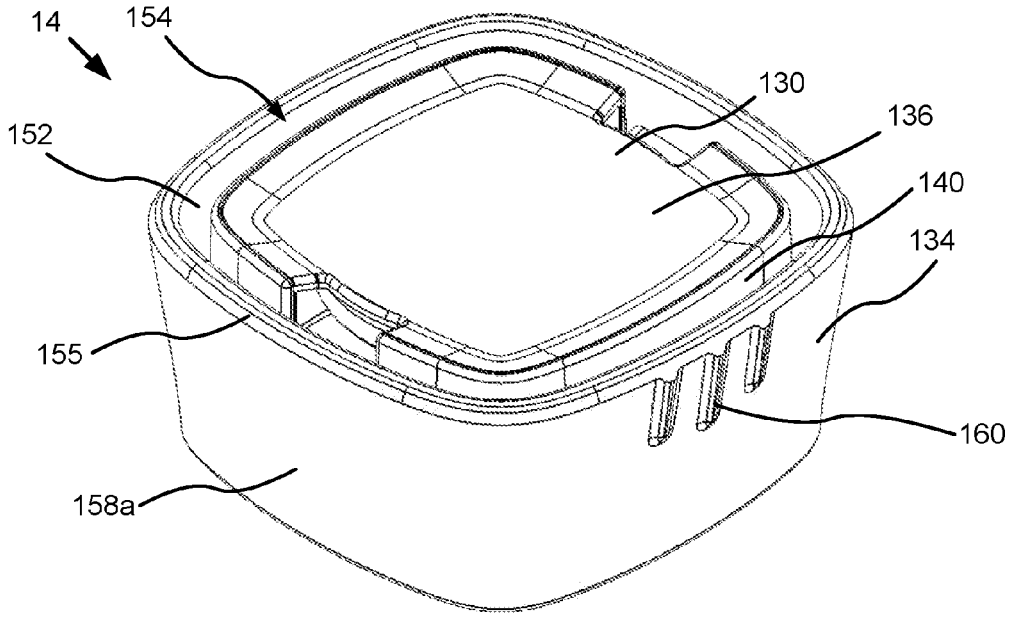
FIG. 15 is a front, top, and perspective view illustration of a child-resistant senior-friendly closure of the plurality of closures in FIG. 1, according to one embodiment.
Figure 16:
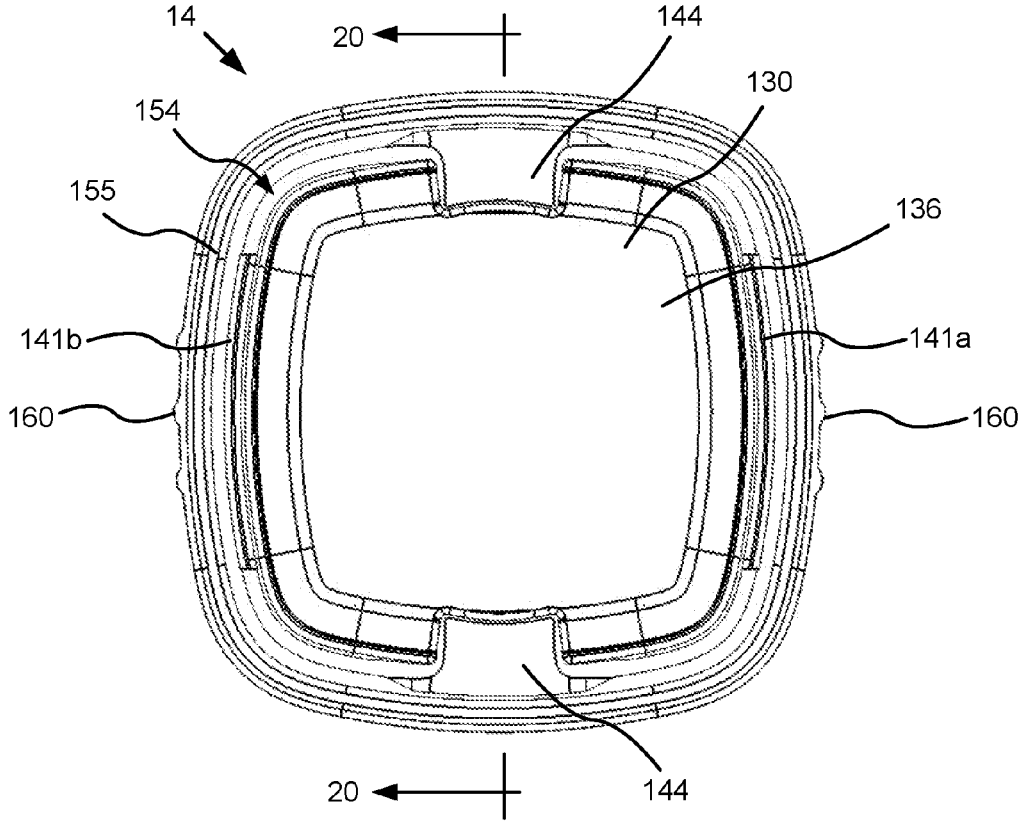
FIG. 16 is a top view illustration of the child-resistant senior-friendly closure of FIG. 15, according to one embodiment.
Figure 17:
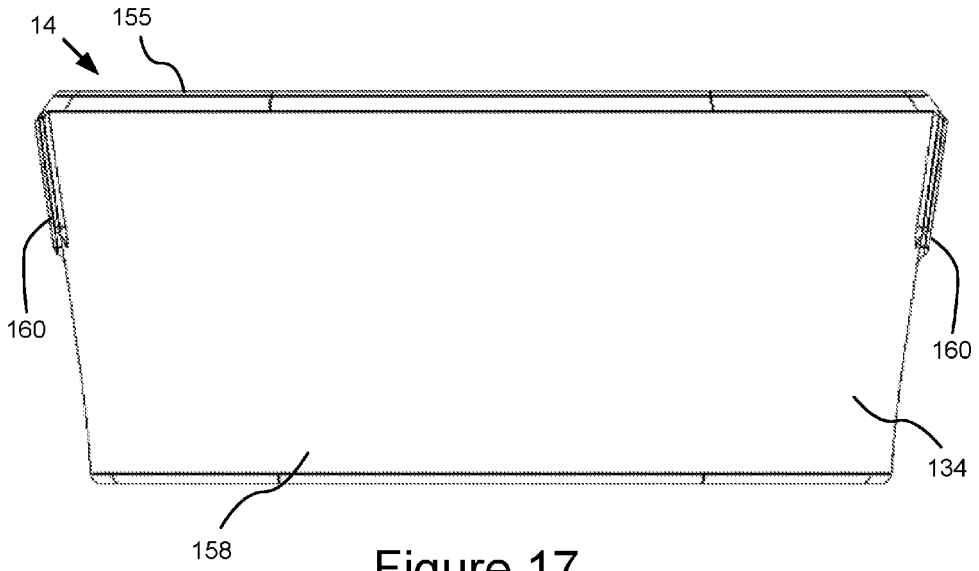
FIG. 17 is a front view illustration of the child-resistant senior-friendly closure of FIG. 15, according to one embodiment.
Figure 18:
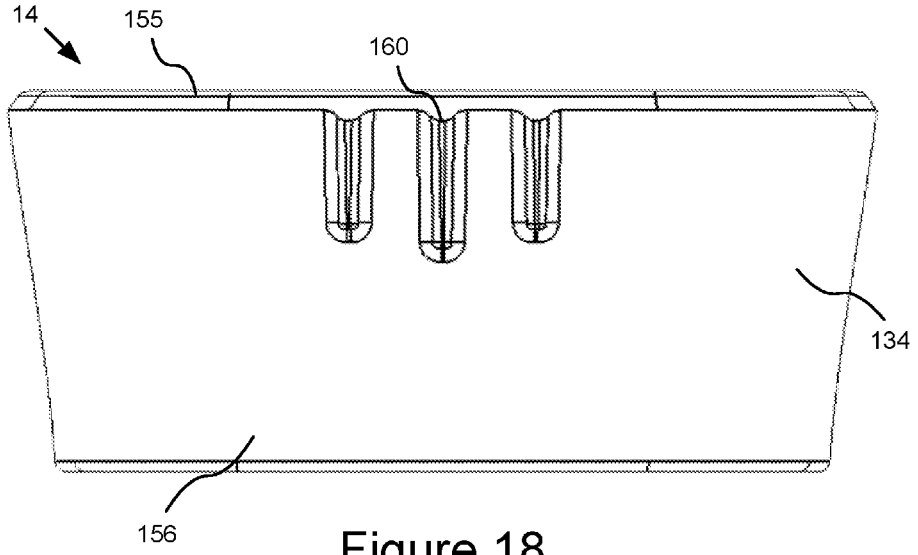
FIG. 18 is a side view illustration of the child-resistant senior-friendly closure of FIG. 15, according to one embodiment.
Figure 19:
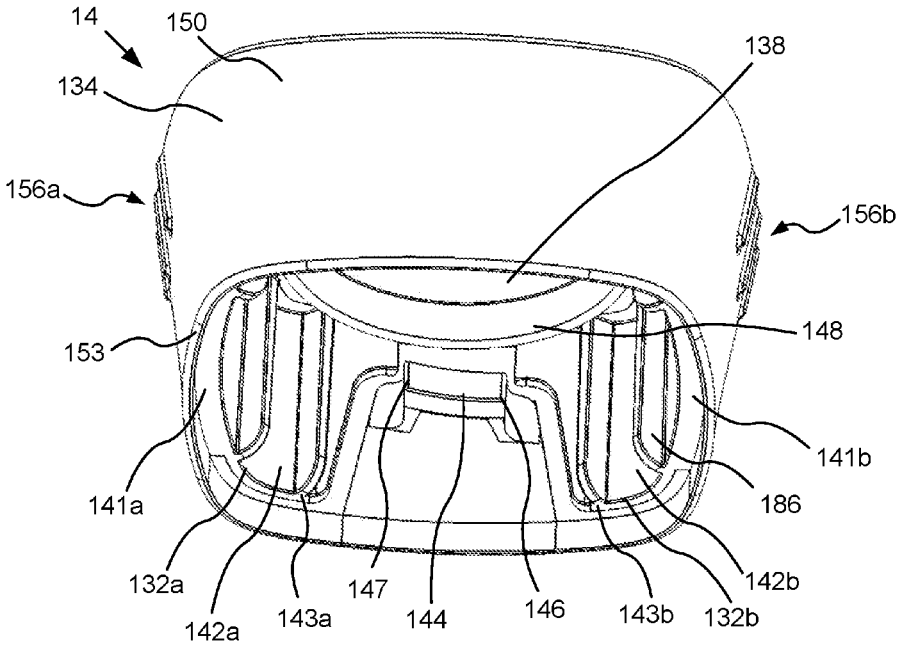
FIG. 19 is a bottom, front, and perspective view illustration of the child-resistant senior-friendly closure of FIG. 15, according to one embodiment.
Figure 20:
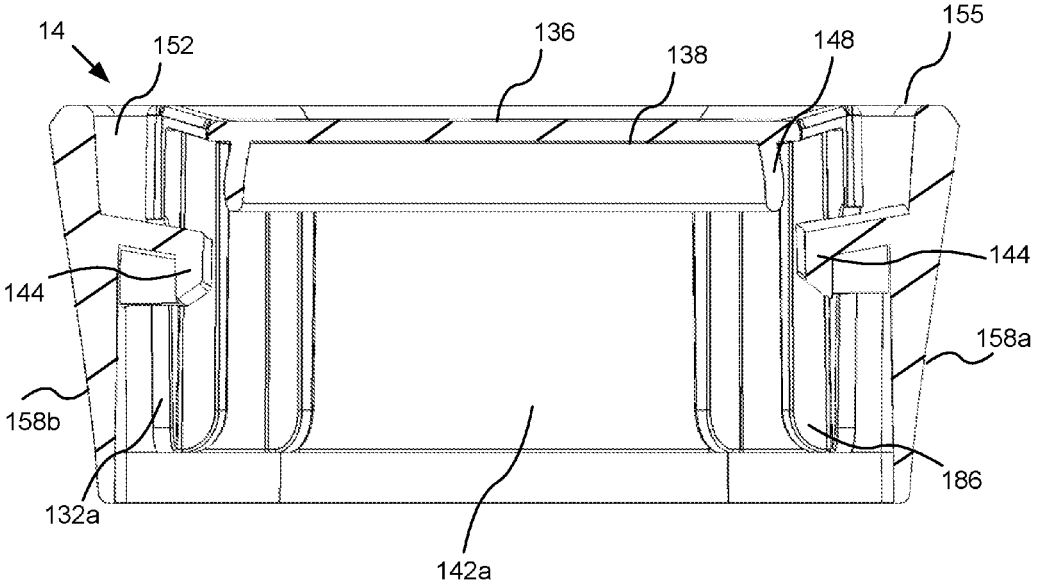
FIG. 20 is a cross-sectional view illustration of the child-resistant senior-friendly closure taken along line 20-20 in FIG. 16, according to one embodiment.
Figure 21:
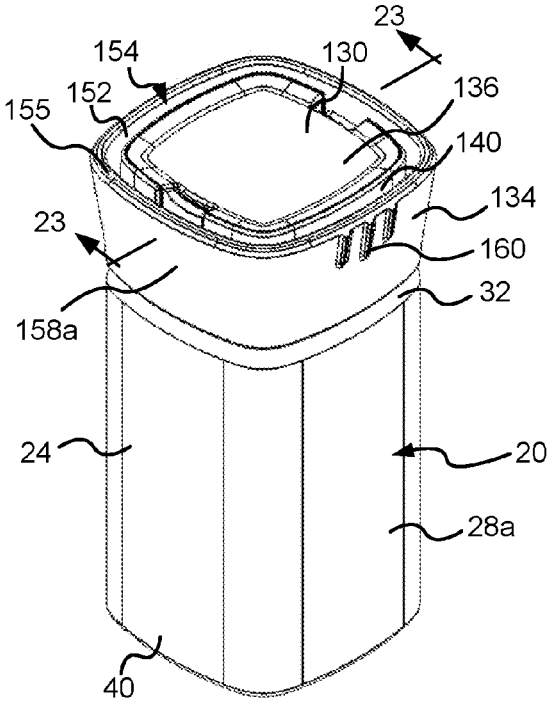
FIG. 21 is a front, top, and perspective view illustration of an assembled pharmacy container including the first bottle in FIG. 1 and the child-resistant senior-friendly closure of FIG. 15, according to one embodiment.
Figure 22:
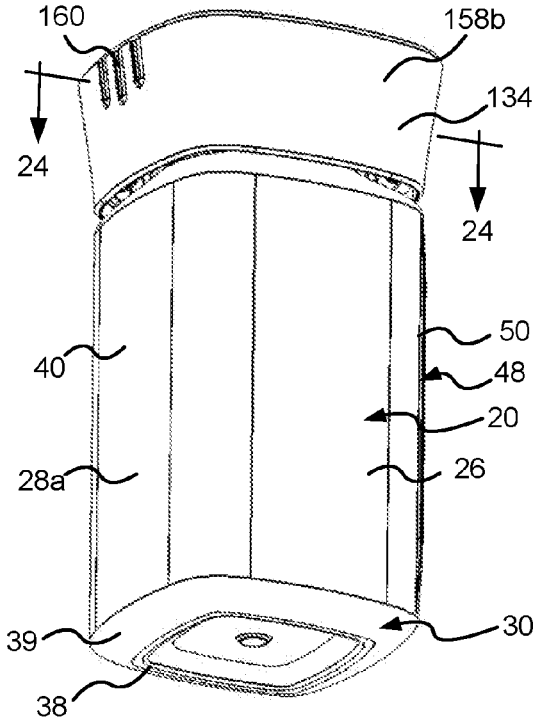
FIG. 22 is a rear, bottom, and perspective view illustration of an assembled pharmacy container including the first bottle in FIG. 1 and the child-resistant senior-friendly closure of FIG. 15, according to one embodiment.
Figure 23:
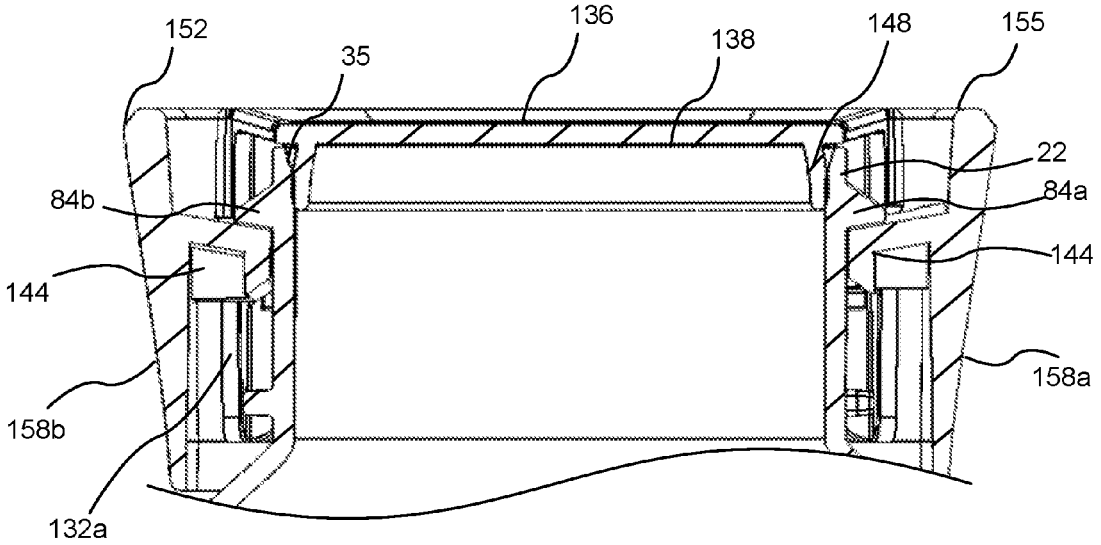
FIG. 23 is a cross-sectional view illustration of a detail of the assembled pharmacy container taken along line 23-23 in FIG. 21, according to one embodiment.
Figure 24:
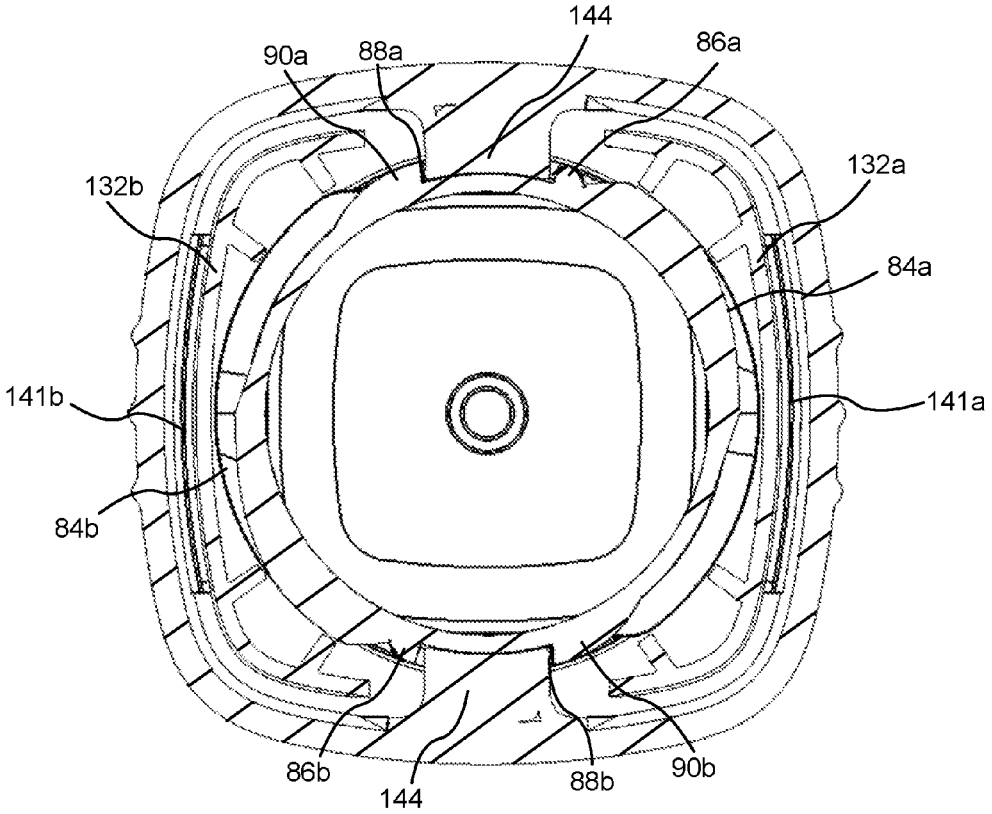
FIG. 24 is a cross-sectional view illustration of a detail of the assembled pharmacy container taken along line 24-24 in FIG. 22, according to one embodiment.
Figure 25:
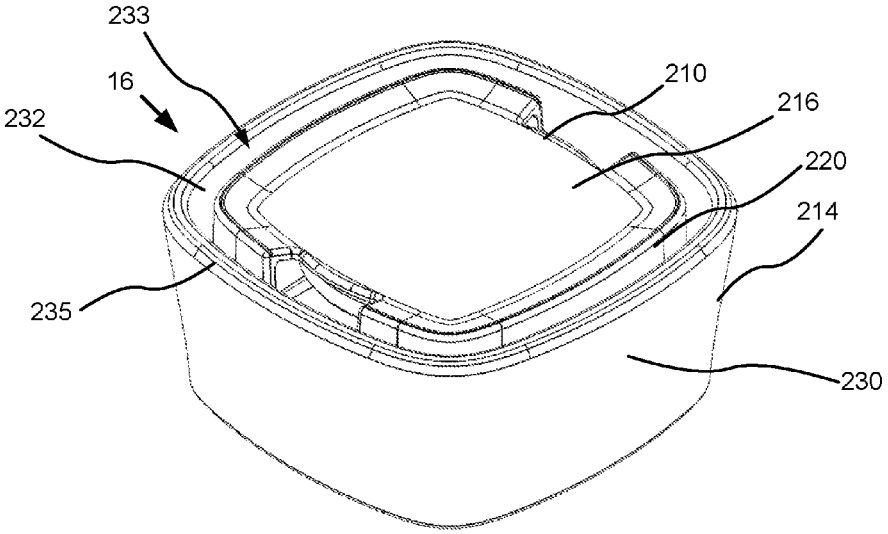
FIG. 25 is a front, top, and perspective view illustration of a non-child-resistant closure of the plurality of closures in FIG. 1, according to one embodiment.
Figure 26:
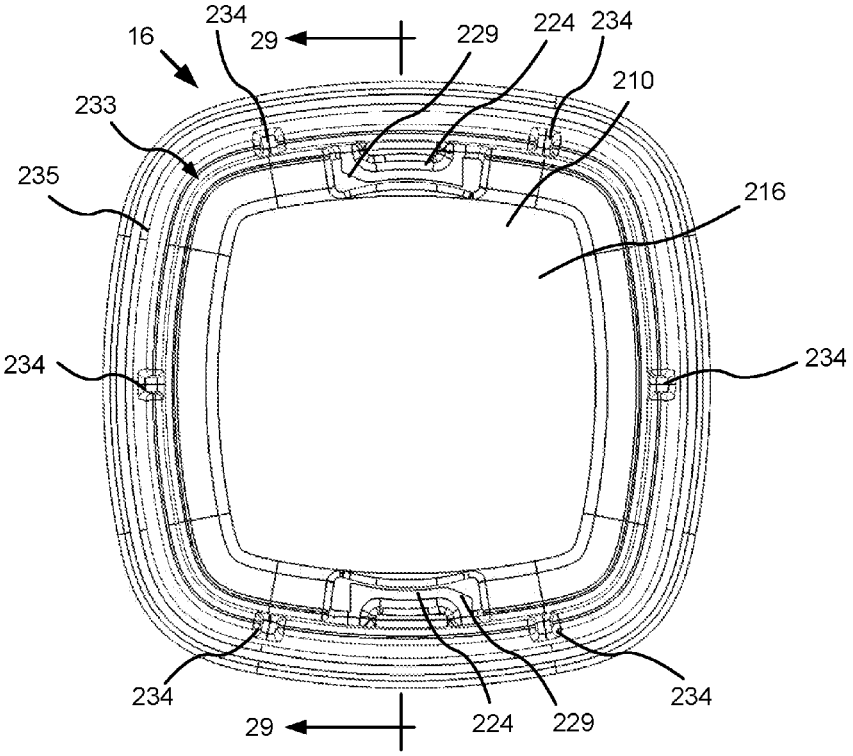
FIG. 26 is a top view illustration of the non-child-resistant closure of FIG. 25, according to one embodiment.
Figure 27:
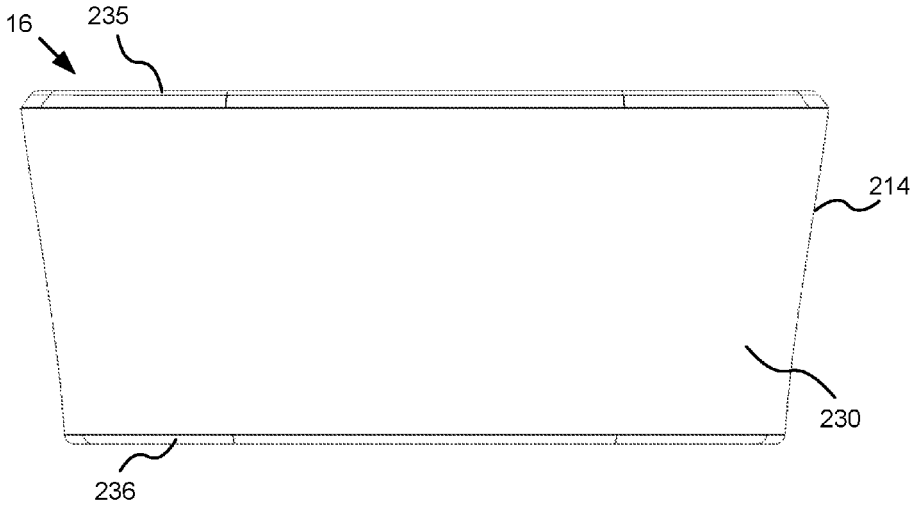
FIG. 27 is a side view illustration of the non-child-resistant closure of FIG. 25, according to one embodiment.
Figure 28:
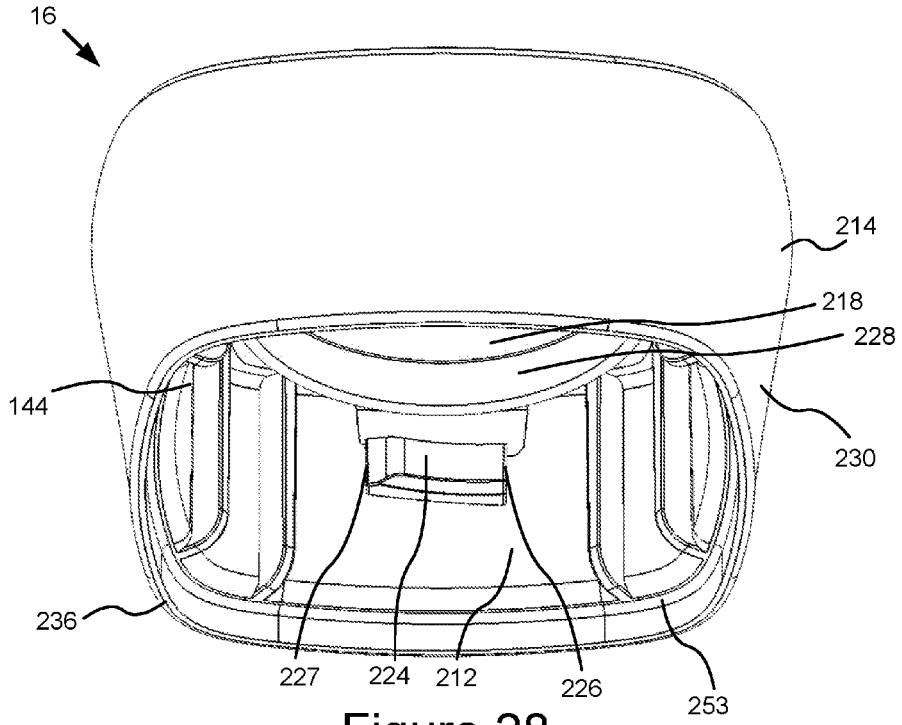
FIG. 28 is a bottom, front, and perspective view illustration of the non-child-resistant closure of FIG. 25, according to one embodiment.
Figure 29:
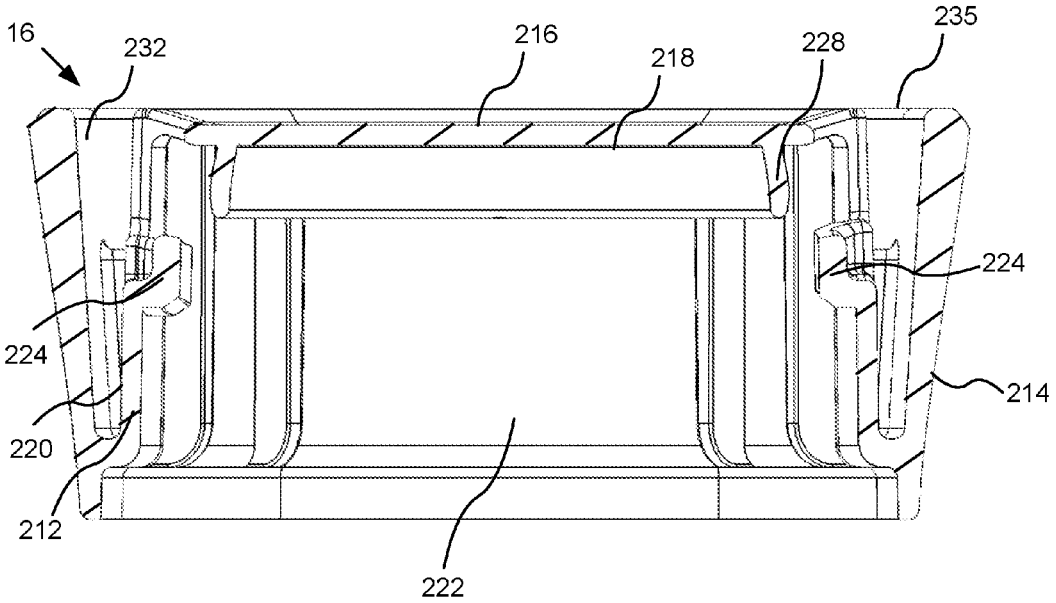
FIG. 29 is a cross-sectional view illustration of the non-child-resistant closure taken along line 29-29 in FIG. 26, according to one embodiment.
Figure 30:
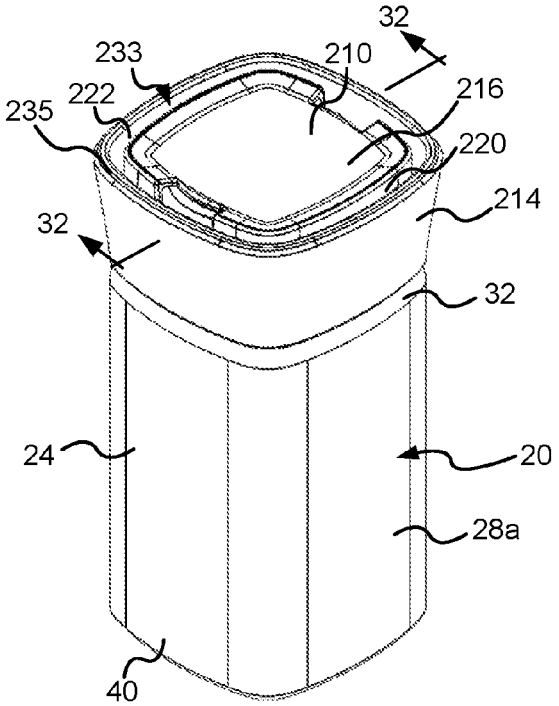
FIG. 30 is a front, top, and perspective view illustration of an assembled pharmacy container including the first bottle in FIG. 1 and the non-child-resistant closure of FIG. 25, according to one embodiment.
Figure 31:
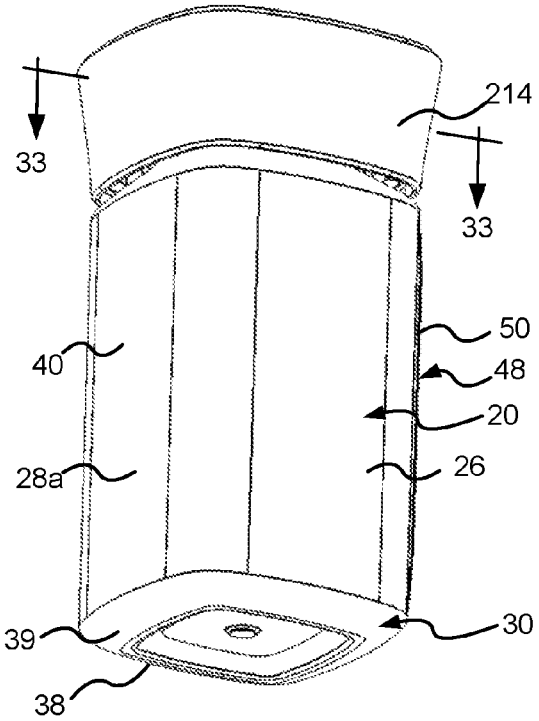
FIG. 31 is a rear, bottom, and perspective view illustration of an assembled pharmacy container including the first bottle in FIG. 1 and the non-child-resistant closure of FIG. 25, according to one embodiment.
Figure 32:
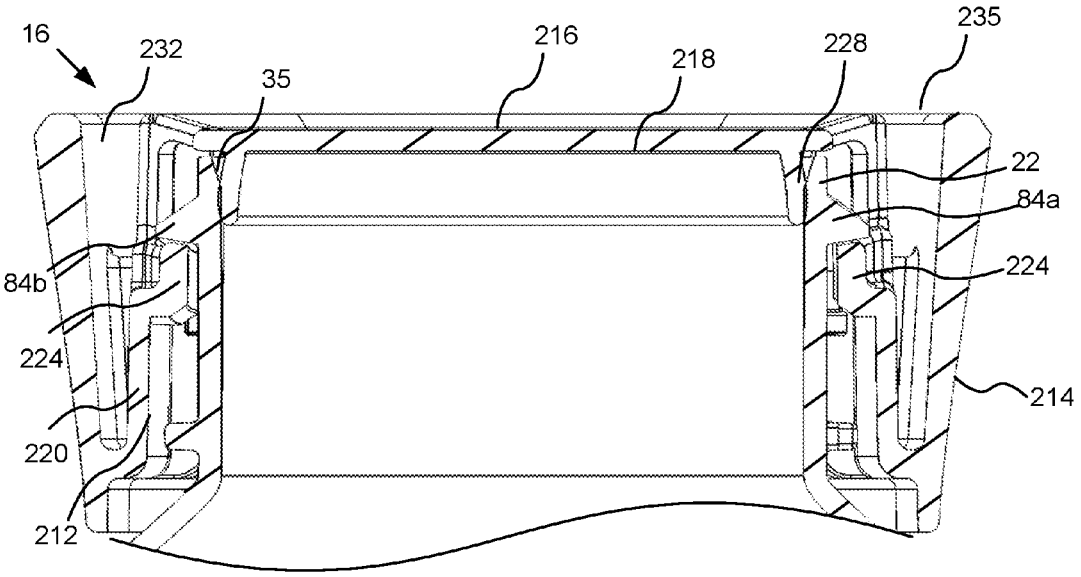
FIG. 32 is a cross-sectional view illustration of a detail of the assembled pharmacy container taken along line 32-32 in FIG. 30, according to one embodiment.
Figure 33:
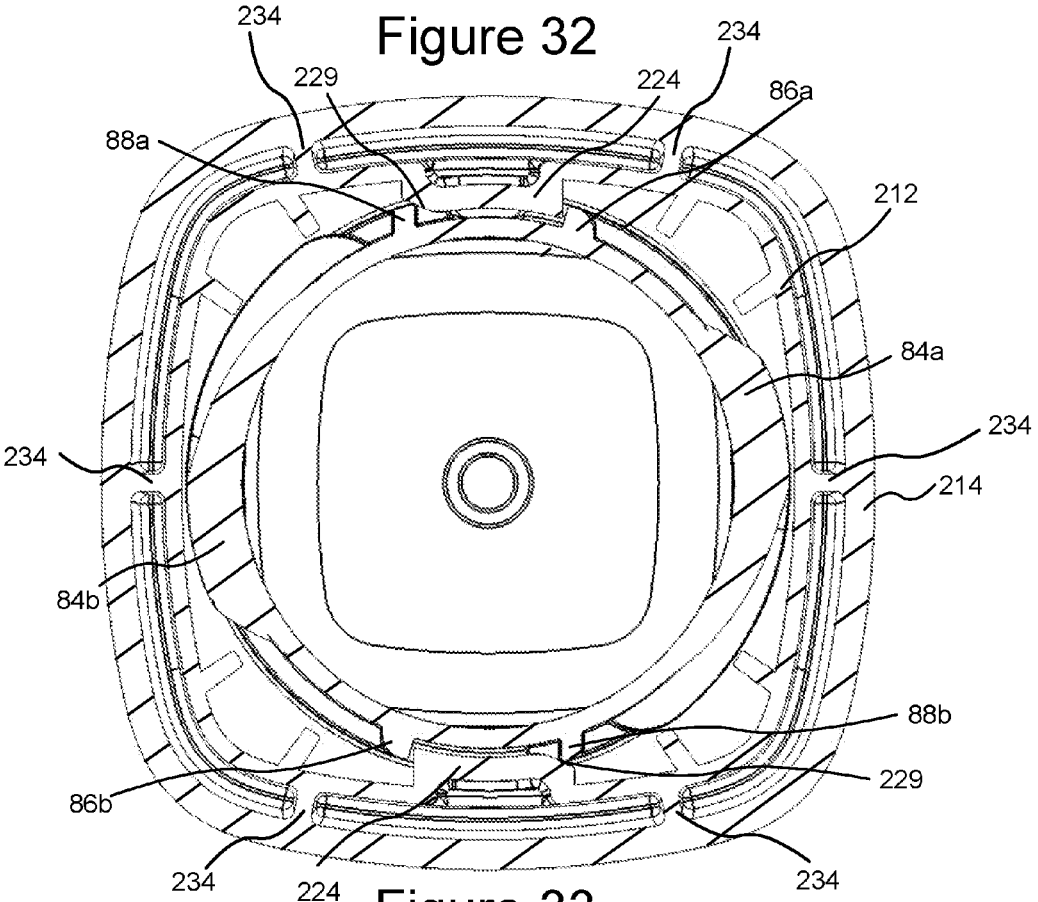
FIG. 33 is a cross-sectional view illustration of a detail of the assembled pharmacy container taken along line 33-33 in FIG. 31, according to one embodiment.

Referring to FIGS. 3, 5, and 7, one panel of body 20 (left side panel 28*b* as illustrated in FIGS. 3, 5, and 7) further comprises a raised region 48 extending between the bottom panel 30 and the shoulder 32, along at least a portion of the panel. In one embodiment, raised region 48 comprises a left edge 50 and a right edge 52. Left edge 50 and right edge 52 define opposing lateral boundaries of raised region 48. Accordingly, in some embodiments, raised region 48 extends only partially longitudinally across a portion of left side panel 28*b* of body 20. In one embodiment, raised region 48 is configured to provide an alignment aid when affixing a label to body 20 of bottle 12*a*. For example, a bottle label (not shown) is positioned to extend over and be adhered to substantially planar surface 40 around (e.g., on two or more sides of) body 20 in a manner that information printed on the bottle label is aligned such that text does not wrap around the body 20 (e.g., continuous text is readable on a single panel of the body so the reader does not need to turn the bottle). In one embodiment, bottle 12*b* and bottle 12*c* each include a raised region to provide an alignment aid when affixing a label to the body of the bottle. The alignment aid on the various sized bottles 12*a*, 12*b*, and 12*c*, are configured such that labels affixed to different sized bottles are vertically aligned when the bottom panel of the bottles are placed on a support surface.

In one embodiment, front panel 24 and rear panel 26 are generally symmetric with each other regarding a size and general shape (e.g., substantially rectangularly shaped) and side panels 28 are generally symmetric with each other regarding a size and general shape (e.g., substantially rectangularly shaped). In another embodiment, front panel 24 and rear panel 26 are generally asymmetric with each other regarding a size or a general shape and side panels 28 are generally asymmetric with each other regarding a size or a general shape.

Returning to a top portion of bottle 12*a*, in one embodiment, shoulders 32, which extend inward from each of front panel 24, rear panel 26, and side panels 28 to a centrally located neck 22, taper inwardly to meet neck 22. Neck 22 defines an exterior neck surface 82, which is substantially smooth, in one embodiment. Where neck 22 is threaded to receive one or both of CRSF closure 14 and non-CR closure 16, threads 84 extend circumferentially around the exterior neck surface. Lugs 144 in CRSF closure 14 and lugs 224 in non-CR closure 16 are configured to act as internal threads that engage with the external threads 84 of neck 22 down the entire length of travel to draw the closure down over the neck. In one embodiment, two sets of opposing threads 84 are used to allow either of CRSF closure 14 and non-CR closure 16 to be tightly held over neck 22 without requiring excessive rotation of CRSF closure 14 or non-CR closure 16.

In one embodiment, rib 85*a* and rib 85*b* circumferentially extend partially around neck 22. Rib 85*a* and rib 85*b* are positioned between threads 84 and shoulder 32 of bottle 12*a* and connect to the underside of threads 84 and acts as a reverse guide when lugs 144 in CRSF closure 14 are released from lug retention area 92. Rib 85*a* and rib 85*b* each terminate at one end by extending into the lug retention area 92*b* and 92*a*, respectively, to create bottom stops 87*b* and 87*a* that prevent lugs 144 in CRSF closure 14 and lugs 224 in non-CR closure 16 from moving below threads 84.

In one embodiment, a stop 86*b* is formed on neck surface 82 and extends downwardly from thread 84*b*, protruding outwardly from a sidewall of neck 22. In one embodiment, a stop 88*b* is similarly formed on neck surface 82 and extends downwardly from thread 84*b*, protruding outwardly from a sidewall of neck 22. In one embodiment, corresponding stops 86*a* and 88*a* are formed on an opposite side of neck 22. In one embodiment, stops 86 are configured to interact with lugs 144 in CRSF closure 14 and lugs 224 non-CR closure 16 to decrease over tightening or rotation of the corresponding CRSF closure 14 and non-CR closure 16. In one embodiment, stops 88 are configured to interact with lugs 144 in CRSF closure 14 and lugs 224 in non-CR closure 16 to retain the closure in place over the opening. Stops 86 and 88 define a lug retention area 92 into which lugs 144 of CRSF closure 14 and lugs 224 of non-CR closure 16 fit when the closures are in place. In one embodiment, a ramped surface 90*b* is formed on neck surface 82 and extends along a bottom of thread 84*b* to stop 88*b*. As illustrated, ramped surface 90*b* includes an angled surface extending increasingly outwardly from neck 22 from a leading edge of ramped surface 90*b*, wherein the leading edge is considered the first edge of the ramped surface 90*b* encountered when a lug 144 in CRSF closure 14 or a lug 224 non-CR closure is turned clockwise to tighten the respective closure around neck 22. The ramped surface 90*b* is configured to lift and guide the lugs 144 in CRSF closure 14 and lugs 224 in non-CR closure 16 over stop 88*b* and into lug retention area 92. In one embodiment, a corresponding ramped surface 90*a* is formed on an opposite side of neck 22. Stops 86 and 88, lug retention area 92, and ramped surface 90 is one example of means for receiving and/or retaining CRSF closure 14 or non-CR closure 16. While depicted as a right-handed closure, it should be understood that the threads may be reversed and the closure may be tightened by turning counter-clockwise.

FIGS. 15-20 illustrate CRSF closure 14, according to one embodiment. As illustrated, CRSF closure 14 includes a top panel 130, an inner sidewall or skirt 132, and an outer sidewall or outer frame 134. As depicted, top panel 130 is square shaped, although other suitable shapes are also contemplated, and defines an exterior surface 136 and an interior surface 138 opposite exterior surface 136. Skirt 132 generally follows the shape of top panel and, in one embodiment, is separated into two skirt portions 132*a* and 132*b*, the two skirt portions 132*a* and 132*b* flanking lugs 144. In one embodiment, skirt 132 is coupled with, and extends downwardly from the outermost perimeter of, top panel 130. In one embodiment, skirt 132 is coupled with, and extends upwardly from outer frame 134. Skirt 132, more particularly, defines an outer surface 140, an inner surface 142 opposite outer surface 140, and a bottom edge 143. Skirt portions 132*a* and 132*b* flank lugs 144 to allow the lugs 144 to interface with threads 84 around neck 22 to securely hold CRSF closure 14 on neck 22 and over opening 36.

In one embodiment, CRSF closure 14 additionally includes a ring 148 protruding downwardly from interior surface 138 of top panel 130 inside skirt 132. Ring 148 is configured to interface with neck 22 to seal opening 36 in a liquid-tight manner In one embodiment, neck 22 includes a chamfer 35 to aid in engagement of ring 148 into the opening 36. While a particular seal geometry is depicted in the example figures, it should be understood that additional geometries may be used for the seal.

Outer frame 134 extends upwardly from the outermost perimeter of skirt 132, in one embodiment, with a slight outward flare. In one embodiment, outer frame 134 includes an outer surface 150, an inner surface 152 opposite outer surface 150, and a bottom edge 153. As illustrated, a void 154 is defined between outer surface 140 of skirt 132 and inner surface 152 of outer frame 134. In one embodiment, bottom edge 143*a* of skirt portion 132*a* is coupled with a grip portion 156*a* of outer frame 134, between bottom edge 153 and top edge 155, and bottom edge 143*b* of skirt portion 132*b* is coupled with a grip portion 156*b* of outer frame 134, between bottom edge 153 and top edge 155, to create two lever points 141*a* and 141*b*. Void 154 allows outer frame 134 to deform around lever points 141*a* and 141*b* under outside forces to grip portion 156*a* and grip portion 156*b* of outer frame 134. In one embodiment, outer frame 134 extends further away from top panel 130 than skirt 132 such that a bottom edge 143 of skirt 132 is positioned nearer top panel 130 than a bottom edge 153 of outer frame 134.

Outer frame 134, in one embodiment, includes opposing grip portions 156 on opposite sides of outer frame 134. The lever points 141*a* and 141*b* permit deflection of opposing grip portions 156 relative to the rest of outer frame 134 when external force (e.g., pinching between finger and thumb) squeezes the opposing grip portions 156 toward one another. The deflection of opposing grip portions 156 deforms outer frame 134 such that lug portions 158 of outer frame 134 move outward away from neck 22. The movement of lug portions 158 outward allows lugs 144 to release from lug retention areas 92*a* and 92*b* such that CRSF closure 14 can be removed from neck 22.

In one embodiment, grip portions 156 are configured with various features facilitating a user in gripping and squeezing the appropriate portions of CRSF closure 14. Grip portions 156 include grip ribs 160 which may bump out, as illustrated, to facilitate proper grasping and squeezing of grip portions 156, according to one embodiment.

In one embodiment, CRSF closure 14 includes additional features to establish CRSF closure 14 as being child-resistant. In one embodiment, the additional features include lugs 144 that engage with lug retention areas 92 to secure CRSF closure 14. When lugs 144 are engaged with lug retention areas 92, stops 86 and 88 make it substantially difficult, (i.e., near impossible for a person not squeezing grip portions 156), to turn CRSF closure 14 counterclockwise to move lugs back over and past stops 88 to remove CRSF closure 14 from bottle 12*a*. Lugs 144 include a leading edge 146 and a trailing edge 147, wherein the leading edge 146 is considered the first edge of a lug 144 to encounter threads 84 or stops 88 and 86 on neck 22 as CRSF closure 14 is turned clockwise to tighten the respective closure around neck 22. Stop 86 is configured to engage with leading edge 146 of a lug 144 in CRSF closure 14 to decrease over tightening or rotation of CRSF closure 14. Stop 88 is configured to engage with trailing edge 147 of a lug 144 in CRSF closure 14 to secure CRSF closure as described elsewhere herein.

In one embodiment, CRSF closure 14 additionally includes various reinforcing fins 186 extending from inner surface 142 skirt 132. Reinforcing fins 186 provide additional rigidity to CRSF closure 14 without impeding flexing of grip portions 156. For example, flexing of grip portions 156 is used to allow an adult (e.g., a non-child) to remove CRSF closure 14 from bottle 12*a* as described elsewhere herein. Additionally, reinforcing fins 186 help guide CRSF closure 14 into position to be secured over neck 22. One example, of an assembled pharmacy container including bottle 12*a* and CRSF closure 14 is illustrated with additional detail in FIGS. 21-24.

In one embodiment, CRSF closure 14 additionally includes indicia (not shown) on exterior surface 136 of top panel 130 providing instructions to a user for interacting with CRSF closure 14. For example, indicia may include text and graphic indications instructing a user to squeeze grip portions 156 and turn CRSF closure 14 to remove CRSF closure 14 from bottle 12*a* to open bottle 12*a* and access its contents. In one embodiment, indicia are raised (e.g., printed, embossed, molded, etc.) and protrude slightly upwardly from exterior surface 136 of top panel 130. In one embodiment, indicia are imprinted (e.g., etched, carved, punched, etc.) and are recessed slightly within exterior surface 136 of top panel 130.

FIGS. 25-29 illustrate a non-CR closure 16 for use on any of bottles 12*a*, 12*b*, and 12*c* as an alternative to CRSF closure 14. In one embodiment, non-CR closure 16 includes a top panel 210, a skirt 212, and an outer frame 214. As depicted, top panel 210 is square shaped, although other suitable shapes are also contemplated, and defines an exterior surface 216 and an interior surface 218 opposite exterior surface 216. Skirt 212 generally follows the shape of top panel and, in one embodiment, includes lugs 224. In one embodiment, skirt 212 is coupled with, and extends downwardly from the outermost perimeter of, top panel 210. In one embodiment, skirt 212 is coupled with, and extends upwardly from outer frame 214. Skirt 212, more particularly, defines an outer surface 220, an inner surface 222 opposite outer surface 220, and a bottom edge 253. Lugs 224 interface with threads 84 around neck 22 to securely hold non-CR closure 16 on neck 22 and over opening 36.

In one embodiment, non-CR closure 16 additionally includes a ring 228 protruding downwardly from interior surface 218 of top panel 210 inside skirt 212. Ring 228 is configured to interface with neck 22 to seal opening 36 in a liquid-tight manner Outer frame 214 extends upwardly from the outermost perimeter of skirt 212, in one embodiment, with a slight outward flare. In one embodiment, outer frame 214 includes an outer surface 230, an inner surface 232 opposite outer surface 230, and a bottom edge 236. As illustrated, a void 233 is defined between outer surface 220 of skirt 212 and inner surface 232 of outer frame 214. Ribs 234 connect inner surface 232 of outer frame 214 to outer surface 220 of skirt 212 and prevent deformation of outer frame 214. In one embodiment, bottom edge 253 of skirt 212 is coupled with outer frame 214 between bottom edge 236 and top edge 235. In one embodiment, outer frame 214 extends further away from top panel 210 than skirt 212 such that a bottom edge 253 of skirt 212 is positioned nearer top panel 210 than a bottom edge 236 of outer frame 214.

In one embodiment, non-CR closure 16 includes lugs 224 that engage with lug retention areas 92 to secure non-CR closure 16. When lugs 224 are engaged with lug retention areas 92, lead ramp 229 on lugs 224 extends beyond lug retention area, such that lugs 224 do not fully seat in lug retention area and allows the lugs 224 to release easily from the lug retention area 92 without having to deform outer frame 214 of non-CR closure 16. Lugs 224 include a leading edge 226 and a trailing edge 227, wherein the leading edge 226 is considered the first edge of a lug 224 to encounter threads 84 or stops 88 and 86 on neck 22 as non-CR closure 16 is turned clockwise to tighten the respective closure around neck 22. Stop 86 is configured to engage with leading edge 226 of a lug 224 in non-CR closure 16 to decrease over tightening or rotation of non-CR closure 16. Stop 88 is configured to engage with lead ramp 229 of a lug 224 in non-CR closure 16 to secure CRSF closure as described elsewhere herein. While depicted as a right-handed closure, it should be understood that the threads may be reversed and the closure may be tightened by turning counter-clockwise.

In one embodiment, non-CR closure 16 additionally includes indicia (not shown) on exterior surface 216 of top panel 210 providing instructions to a user for interacting with non-CR closure 16 and/or indicating that non-CR closure 16 is not child-resistant. In one embodiment, indicia are raised (e.g., printed, embossed, molded, etc.) and protrude slightly upwardly from exterior surface 216 of top panel 210. In one embodiment, indicia are imprinted (e.g., etched, carved, punched, etc.) and are recessed slightly within exterior surface 216 of top panel 210. In one embodiment, non-CR closure 16 is identified as not child-resistant by differing in color from CRSF closures (e.g., non-CR closure may be grey while CRSF closure is white). In one embodiment, surface of non-CR closure 16 may include texture to identify the closure as not child-resistant. FIGS. 30-33 illustrate an assembled pharmacy container including bottle 12*a* and non-CR closure 16.

Although specific embodiments have been illustrated and described herein, it will be appreciated by those of ordinary skill in the art that a variety of alternate and/or equivalent implementations may be substituted for the specific embodiments shown and described. This application is intended to cover any adaptations or variations of the specific embodiments discussed herein.

What is claimed is:

1. A container comprising:

a bottle including:

a body defining a chamber therein;

a neck extending away from the body and defining an opening to the chamber of the body, wherein:

the neck includes threads extending around an outside surface of the neck from the opening toward the body;

the neck includes a first stop and a second stop, on the outside surface of the neck, extending from a bottom of a first thread toward the body, the first stop and the second stop defining a first lug retention area; and the neck includes a first ramped surface extending along the bottom of the first thread to the first stop on the outside surface of the neck, the first ramped surface extending increasingly outwardly from the outside surface of the neck; and a closure configured to be secured over the opening and around the neck, wherein the closure includes a first lug configured to interface with the first thread and engage with the first lug retention area to retain the closure in place over the opening, wherein the first ramped surface is configured to guide the first lug into the first lug retention area as the closure is secured over the opening.

2. The container of claim 1, wherein:

the neck includes a third stop and a fourth stop, on the outside surface of the neck, extending from a bottom of a second thread toward the body, the third stop and the fourth stop defining a second lug retention area, the second lug retention area opposite the first lug retention area;

the closure includes a top, a first skirt portion coupled with the top and a second skirt portion coupled with the top, the first skirt portion opposite the second skirt portion; and the closure includes an outer frame having:

a first frame portion including the first lug;

a second frame portion including a second lug, the second frame portion opposite the first frame portion;

a third frame portion coupled with the first skirt portion and a fourth frame portion coupled with the second skirt portion, wherein the first lug and the second lug are configured to release from the first lug retention area and the second lug retention area under an external force applied inwardly to the third frame portion and the fourth frame portion.

3. The container of claim 2, wherein the first lug extends radially inward from an inner surface of the first frame portion and the second lug extends radially inward from an inner surface of the second frame portion.

4. The container of claim 2, wherein an edge of the first skirt portion opposite the top is coupled with an inner surface of the third frame portion and an edge of the second skirt portion opposite the top is coupled with an inner surface of the fourth frame portion.

5. The container of claim 1, wherein the first lug includes a leading edge and a trailing edge when engaging the first lug retention area, the trailing edge including a lead ramp configured to shallowly engage with the first lug retention area.

6. The container of claim 1, wherein the first ramped surface begins between the first thread and a second thread.

7. The container of claim 1, wherein the body defining the chamber includes:

a bottom panel opposite the opening to the chamber of the body;

a plurality of panels, the panels extending from a bottom panel toward the opening, a shoulder extending between the plurality of panels and the neck; and a raised region on a panel of the plurality of panels, the raised region extending between the bottom panel and the shoulder along at least a portion of the panel.

8. The container of claim 1, in combination with medicine maintained in the chamber.

9. The container of claim 1, in combination with a plurality of bottles of different storage volumes including the bottle, the plurality of bottles having a substantially identically sized neck, substantially identically sized threads, and substantially identically sized lug retention area, wherein the closure configured to be secured to any one of the plurality of bottles.

10. A bottle comprising:

a body defining a chamber therein;

a neck extending away from the body and defining an opening to the chamber of the body, wherein:

the neck includes threads extending around an outside surface of the neck from the opening toward the body;

the neck includes a first stop and a second stop, on the outside surface of the neck, extending from a bottom of a first thread toward the body, the first stop and the second stop defining a first lug retention area, wherein the first lug retention area is configured to engage with a first lug of a closure to secure the closure in place over the opening and around the neck; and the neck includes a first ramped surface extending along the bottom of the first thread to the first stop on the outside surface of the neck, the first ramped surface extending increasingly outwardly from the outside surface of the neck and configured to guide the first lug into the first lug retention area as the closure is secured over the opening.

11. The bottle of claim 10, wherein:

the neck includes a third stop and a fourth stop, on the outside surface of the neck, extending from a bottom of a second thread toward the body, the third stop and the fourth stop defining a second lug retention area, the second lug retention area opposite the first lug retention area; and the second lug retention area is configured to engage with a second lug of the closure to secure the closure in place over the opening and around the neck.

12. The bottle of claim 10, wherein the neck includes a first ramped surface, on the outside surface of the neck, extending along the bottom of the first thread to the first stop, the first ramped surface configured to guide the first lug into the first lug retention area as the closure is secured over the opening.

13. The bottle of claim 12, wherein the first ramped surface begins between the first thread and a second thread.

14. The bottle of claim 10, wherein the body defining the chamber includes:

a bottom panel opposite the opening to the chamber of the body;

a plurality of panels, the panels extending from a bottom panel toward the opening;

a shoulder extending between the plurality of panels and the neck; and a raised region on a panel of the plurality of panels, the raised region extending between the bottom panel and the shoulder along at least a portion of the panel.

15. The bottle of claim 10, in combination with a plurality of bottles of different storage volumes including the bottle, the plurality of bottles having a substantially identically sized neck, substantially identically sized threads, and substantially identically sized lug retention area, such that any one of the plurality of bottles is configured to engage with the first lug of the closure to secure the closure.

* * * * *